US007584858B2

(12) United States Patent
Barrett et al.

(10) Patent No.: US 7,584,858 B2
(45) Date of Patent: Sep. 8, 2009

(54) SCREEN ASSEMBLY DESIGNED TO CONFORM TO THE RADIUS OF VIBRATING SHAKERS WITH CROWNED DECKS

(75) Inventors: Robert M. Barrett, Walton, KY (US); Brian S. Carr, Burlington, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 12/050,841

(22) Filed: Mar. 18, 2008

(65) Prior Publication Data

US 2008/0179222 A1 Jul. 31, 2008

Related U.S. Application Data

(62) Division of application No. 10/868,206, filed on Jun. 15, 2004.

(51) Int. Cl.
*B07B 1/49* (2006.01)

(52) U.S. Cl. ..... 209/405; 209/274; 209/413

(58) Field of Classification Search ..... 209/274, 209/412, 413, 392, 404, 405, 409
See application file for complete search history.

(56) References Cited

U.S. PATENT DOCUMENTS

| | | | | | |
|---|---|---|---|---|---|
| 3,980,555 | A * | 9/1976 | Freissle | ..... | 209/408 |
| 4,374,169 | A * | 2/1983 | Gryskiewicz et al. | ..... | 428/221 |
| 4,674,251 | A * | 6/1987 | Wolff | ..... | 52/309.15 |
| 4,857,179 | A * | 8/1989 | Kimble et al. | ..... | 209/166 |
| 5,417,859 | A * | 5/1995 | Bakula | ..... | 210/388 |
| 5,927,511 | A * | 7/1999 | Riddle et al. | ..... | 209/405 |
| 6,006,923 | A * | 12/1999 | Helmy et al. | ..... | 209/397 |
| 6,202,857 | B1 * | 3/2001 | Keller et al. | ..... | 209/404 |
| 6,543,621 | B2 * | 4/2003 | Baltzer et al. | ..... | 209/405 |
| 6,938,779 | B2 * | 9/2005 | Burnett | ..... | 209/405 |

* cited by examiner

*Primary Examiner*—Patrick H Mackey
*Assistant Examiner*—Mark Hageman
(74) *Attorney, Agent, or Firm*—Osha • Liang LLP

(57) ABSTRACT

A screen assembly that is sufficiently flexible to adapt to a non-planar profile of a crowned deck on a vibrating shaker. When attached to the crowned deck, the screen assembly provides a screen with less curvature than the crowned deck.

15 Claims, 5 Drawing Sheets

SCREEN ASSEMBLY DESIGNED TO CONFORM TO THE RADIUS OF VIBRATING SHAKERS WITH CROWNED DECKS

CROSS-REFERENCE TO RELATED APPLICATIONS

This is a divisional application and claims benefit under 35 U.S.C. § 120 of U.S. patent application Ser. No. 10/868,206, filed on Jun. 15, 2004.

BACKGROUND OF INVENTION

Background Art

Various types of designs and configurations of vibrating screen machines ("shakers") have been used in the past. These vibrating shakers are used as screening and separation devices in various industries, such as in the drilling and mining industries to recycle drilling mud. During drilling operations, drilling mud or fluid is circulated from the surface, down through a drill string, and down to a drill bit. The drilling mud performs a variety of functions, such as removing cuttings from the well bore that are created by the drill bit during drilling. After use in the well bore, the drilling mud, along with debris and drill cuttings, is brought to the surface where it is screened to remove solids over a certain size. This process allows the drilling mud to be re-used (i.e., recirculated).

In typical shakers, a screen or screen assembly is detachably secured to the vibrating shaker machine. With the screen assembly or multiple screen assemblies secured in place, a tray is formed with the opposed, parallel sidewalls of the shaker. The drilling mud, along with drill cuttings and debris, is deposited on the top of the screen assembly at one side. The screen assembly is vibrated at a high frequency or oscillation by a motor or motors for the purpose of screening or separating materials placed on the screen. The liquid and fine particles will pass through the screen assembly by force of gravity and be recovered underneath. The solid particles above a certain size migrate and vibrate across the screen or screens where they are removed.

It is known that to obtain the proper vibration of the screen assembly, slackness in the screens must be discouraged. Any slackness in the screen produces an undesirable flapping action of the screen, which reduces the effectiveness of the shaker vibration and also results in increased wear of the screen. Accordingly, it is known that the screen should be securely and tightly held down to the vibrating machinery. At the same time, the screen assemblies are subject to stresses from the vibrating machinery and wear over time and require periodic replacement. The migration of solids across the screens also contributes to the wear on the screen assemblies.

One type of attachment mechanism includes hooks on each longitudinal end of the screen assembly to connect to the shaker. The shaker will have a channel-shaped drawbar on each side, which mates with a corresponding hook on the screen assembly. The drawbars are held in place by bolts or other fasteners. These are detachably connected so that the screens may be replaced from time to time.

The shaker may further include a bed or deck composed of a plurality of cushioned rails on which one or more screen assemblies rest. Rather than having the bed or deck for the screen assembly flat or horizontal, the bed may be modified to be arched, bowed, or curved upward so that the screen cloth or screen assembly is stretched tightly over the arched or curved surface. The height of the curvature of the deck may vary from one-half to one inch from the center to the sides. These beds or decks are referred to as crowned decks.

An early example of a screen for a crowned deck shaker is shown in U.S. Pat. No. 1,886,173, entitled "Screen." With a crowned deck, the screen cloth must be flexible enough to conform to the arch in the deck. Additional features to maintain tautness include spring tensioning bolts to prevent loosening as the screens or screen assemblies stretch and seat onto the deck.

The crowned deck and accompanying crowned screen assembly can cause uneven fluid coverage. Because of the crowned deck, the fluid and solids deposited on the screen assembly to be separated will first gather at the sides. Depending on the fluid level, the arched center of the screen assembly may be exposed. The drilling mud to be screened may extend further out along the sides of the shaker deck than at the center where maximum deck height occurs. This will reduce the effective screening area of the vibrating shaker and reduce the efficiency. This condition can also lead to mud losses at the discharge and contribute to unacceptably wet cuttings if the drilling fluid passes across the surface of the screen assembly without being screened.

Several measures have been employed in response to these issues. Manufacturers have modified the vibrating shaker to vary and alter the pitch of the deck itself so the drilling fluid is moving uphill from its entry to discharge. For example, the bed or deck may be set at an incline angle of 1 degree to 4 degrees. The uphill movement of fluid and cuttings helps to ensure that the drilling fluid is properly screened. The inclined deck angle, however, also results in solids moving more slowly across the screen. The solids abrade the screen as they move across. The longer time on the screen results in additional wear on the screen, which lowers screen life.

An alternate measure employed is to corrugate the screen assembly to provide ridges to contact the fluid and assist in channeling the fluid. An example of this approach is provided by U.S. Pat. No. 5,417,859, entitled "Undulating Screen for Vibratory Screening Machine and Method of Fabrication Thereof."

Another solution to the problems associated with a crowned deck is to have a screen assembly with a flat surface on the top and a curved bottom surface to match the curvature of the crowned deck. This approach is shown in U.S. Pat. No. 5,927,511, entitled "Flat Screen Panel for Crowned Deck Vibrating Shaker." The screen assembly is rigid and essentially converts the crowned deck to a flat deck. The flat surface provides a larger effective screening area. However, variation in the curvature of the crowned deck due to varying designs and wearing of the crowned deck may prevent the screen assembly from properly attaching to the crowned deck.

SUMMARY OF INVENTION

In one aspect, the disclosed subject matter relates to a screen assembly for attachment to a crowned deck of a vibrating shaker. The crowned deck has a non-planar profile. The screen assembly includes a screen frame having an underside and a top side. At least one screen mesh is attached to the top side of the screen assembly. The screen assembly is configured to flex such that the underside adapts to the non-planar profile of the crowned deck when the screen assembly is attached to the crowned deck.

In one aspect, the disclosed subject matter relates to a screen assembly for attachment to a crowned deck of a vibrating shaker. The screen assembly includes a screen frame having an underside and a top side. The underside has a curvature such that the underside conforms to a curvature of the crowned deck when attached to the crowned deck. At least one screen mesh is attached to the top side of the screen assembly.

In one aspect, the disclosed subject matter relates to a screen assembly for attachment to a crowned deck of a vibrating shaker. The crowned deck has a non-planar profile. The screen assembly includes a screen frame having an underside and a top side. The screen frame is formed from a primary material and a secondary material. The screen assembly is configured to flex such that the underside adapts to the non-planar profile of the crowned deck when the screen assembly is attached to the crowned deck. At least one screen mesh is attached to the top side of the screen assembly.

In one aspect, the disclosed subject matter relates to a frame for attachment to a crowned deck of a vibrating shaker. The crowned deck has a non-planar profile. The frame has a top side and an underside. The frame is formed from a primary material and a secondary material. The frame is configured to flex such that the underside adapts to the non-planar profile of the crowned deck when the screen assembly is attached to the crowned deck.

In one aspect, the disclosed subject matter relates to a frame for attachment to a crowned deck of a vibrating shaker. The crowned deck has a curvature. The frame has a substantially flat top side and a curved underside. The underside has a curvature greater than the curvature of the crowned deck. The frame further includes two sides configured to attach to the crowned deck and a grid structure formed from a primary material. A support grid formed from a secondary material of greater tensile strength than the primary material is embedded in the primary material. The frame is configured to flex such that the underside adapts to the curvature of the crowned deck when the frame is attached to the crowned deck.

Other aspects and advantages of the invention will be apparent from the following description and the appended claims.

DETAILED DESCRIPTION

In one aspect, the present invention relates to a composite screen assembly for use on vibrating shakers having crowned decks. More specifically, the composite screen assembly has a flexible frame with a curved underside that conforms to the crowned deck when the composite screen assembly is attached to the crowned deck.

Figure 1C:
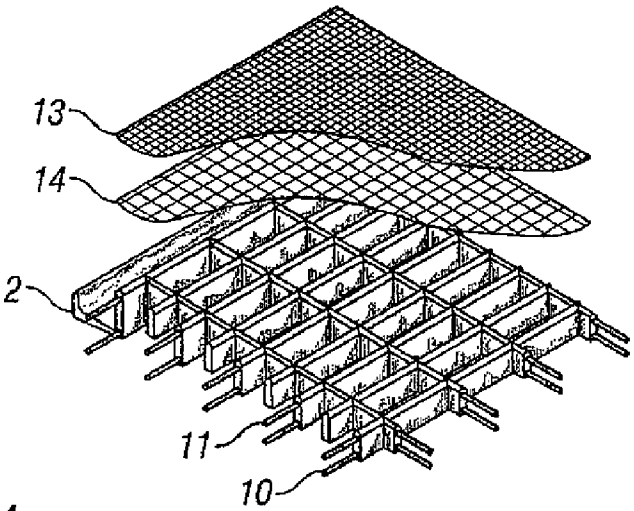
FIG. 1C shows an exploded view of the screen assembly shown in FIG. 1A.
Figure 1A:
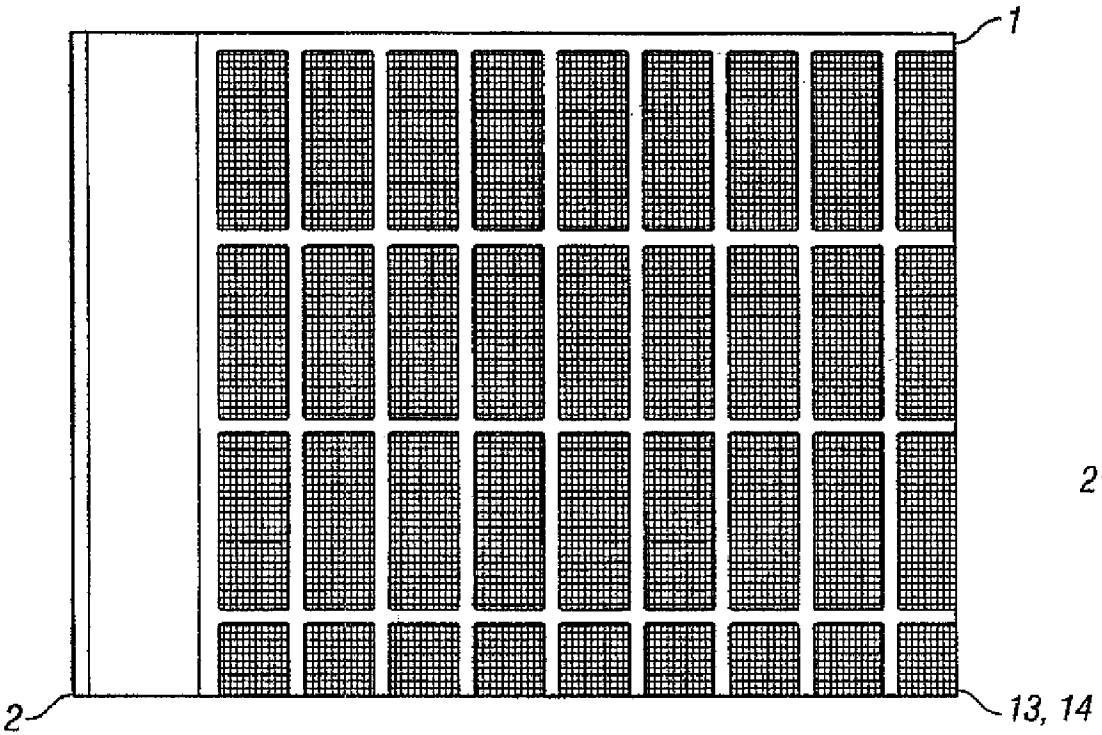
FIG. 1A shows a top view of a quarter of a screen assembly in accordance with one embodiment of the present invention.
Figure 1B:
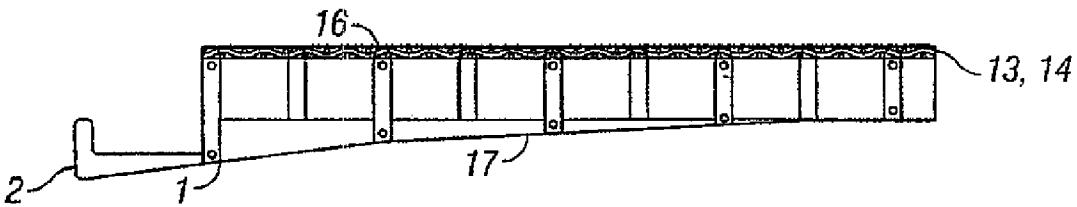
FIG. 1B shows an end view of the screen assembly shown in FIG. 1A.

In FIG. 1A, a top view of one-quarter of a screen assembly in accordance with one embodiment of the present invention is shown. FIG. 1B shows an end view of the screen assembly shown in FIG. 1A. FIG. 1C shows an exploded view of the screen assembly shown in FIG. 1A. The screen assembly includes a screen frame 1. A screen mesh 13 is fixed to the top side 16 of the screen frame 1. Additional intermediate screen meshes 14 may be fixed between the screen mesh 13 and the top side 16 of the screen frame 1. The screen frame 1 may have a hook strip 2 formed on the sides. To install on a crowned deck, tension would be applied to the hook strips 2 on both sides by a tensioning mechanism on the vibrating shaker (not shown) to fasten the screen assembly. When tension is applied, the screen assembly conforms to the shape of the crowned deck. This results in a top side 16 with less curvature than the crowned deck. Those having ordinary skill in the art will appreciate that other connection mechanisms may be used without departing from the scope of the invention.

The screen frame 1 includes an underside 17 that is curved with a radius that is equal to or greater than the crowned deck on which it would be installed. The top side 16 may be substantially planar. The screen frame 1 may have a grid support structure. In this embodiment, the screen frame 1 is formed from two materials. The primary material may be any material that provides a good strength to weight ratio. For handling purposes, a lighter screen frame is generally preferred. Suitable primary materials for the screen frame include various polymeric materials, such as thermoplastics. In particular, polypropylene foam provides a good light weight structure. Besides strength and weight, the chemical and corrosion resistance of the primary material should be considered to prevent deterioration of the screen frame 1 during use. Those having ordinary skill in the art will recognize that other materials may be used without departing from the scope of the invention.

A secondary material may be embedded into the primary material of the screen frame 1. In this embodiment, the secondary material may be selected to provide structural support to the screen frame 1. Suitable materials include most metals. In one embodiment, the secondary material may be in the form of a wire grid formed from steel. If the secondary material is fully embedded in the primary material, chemical resistance and corrosion is not an important characteristic. In FIG. 1C, the ends of a lower support grid 10 and an upper support grid 11, which are embedded in the primary material of the screen frame 1, are visible. The support grids provide structural integrity to the screen frame 1 to withstand the vibrations and forces encountered during use.

Figure 2A:
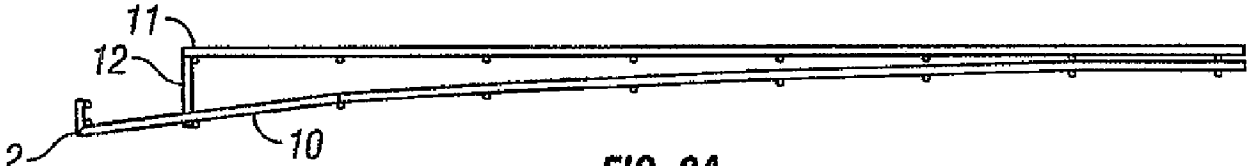
FIG. 2A shows an end view of a half of a support structure for a screen frame in accordance with one embodiment of the present invention.

FIG. 2A shows an end view of half of a support grid for use in a screen frame in accordance with one embodiment of the present invention. FIG. 2A shows the dual support grid shown in FIGS. 1B and 1C. A lower support grid 10 has a hook strip 2 formed on the side. A reinforcement grid truss 12 connects the lower support grid 10 to the upper support grid 11. The resulting support structure may be embedded into the primary material of the screen frame by placing the support structure into a mold with the primary material. The support grid shown in FIG. 2A may be embedded in the screen frame to provide additional strength to the screen frame, while adding minimal weight to the screen assembly.

Figure 2B:
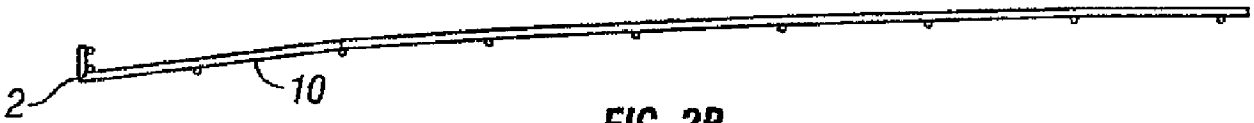
FIG. 2B shows an end view of half of a support structure for a screen frame in accordance with one embodiment of the present invention.

FIG. 2B shows an end view of half of a support grid for use in a screen frame in accordance with one embodiment of the present invention. In FIG. 2B, the screen frame may only have a lower support grid 10 near the underside of the screen frame. The lower support grid 10 is shown in FIG. 2B. The lower support grid 10 provides additional tensile strength to help withstand tension applied during installation, and has a lower weight than the support structure shown in FIG. 2A. The support structure shown in FIG. 2A provides additional strength to reduce movement of the top side 16 of the screen assembly during vibration. Those having ordinary skill in the art will be able to devise alternative support structures to provide strength to the screen frame without departing from the scope of the invention.

Figure 3B:
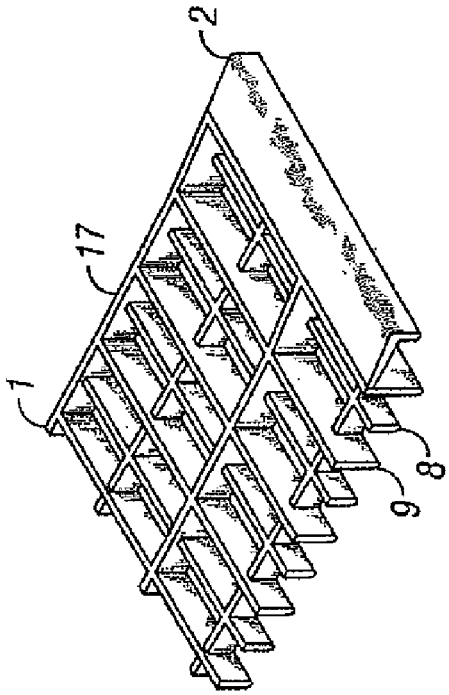
FIG. 3B shows an isometric bottom view of the screen frame shown in FIG. 3A.
Figure 3A:
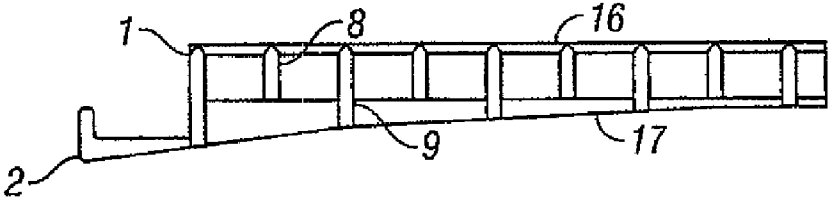
FIG. 3A shows an end view of half of a screen frame in accordance with one embodiment of the present invention.

FIGS. 3A and 3B show a section of the screen frame 1 in accordance with one embodiment of the present invention. In this embodiment, the screen frame 1 is shown having alternating short ribs 8 and long ribs 9. The long ribs 9 extend from a top side 16 to an underside 17 of the screen frame 1. The short ribs 8 only extend from the top side 16 to an intermediate depth. The alternating length of the ribs provides a close grid pattern on the top side 16 for supporting the screen mesh (not shown). If a rip forms in the screen mesh, it will be arrested by the close grid pattern, which results in only a small rip. If a rip forms in a grid cell, that cell can be plugged off to allow for continued use of the screen assembly while only losing a small effective screening area.

Returning to FIG. 1C, after a screen frame has been formed, one or more screen meshes (13, 14) are attached to the top side 16 of the screen frame 1. In one embodiment, the screen frame 1 may be a thermoplastic as the primary material. The screen meshes (13, 14) may be made of metal wire. The screen mesh 14 may be fused to the screen frame 1 by heating the screen mesh 14 to a temperature selected such that the particular thermoplastic will be able to deform easily without damaging the material permanently. During heating, the screen mesh 14 may be pulled in tension, and then pressed against the top side 16 of the screen frame 1. Because of the elevated temperature, the screen mesh 14 fuses to the screen frame 1. After cooling, the screen mesh 14 is permanently fused to the screen frame 1 as a screen assembly. If more than one screen mesh 14 is desired, such as the two shown in FIG. 1C, the additional screen mesh 13 may be fused separately or simultaneously with the other screen mesh 14. Alternatively, the screen mesh 13 may be fused to the screen frame 1 with screen mesh 13 trapped between screen mesh 14 and the screen frame 1. While one manufacturing technique is explained, one of ordinary skill in the art will appreciate that other methods for fixing a screen mesh to a screen frame (i.e., fasteners or adhesives) may be used without departing from the scope of the invention.

Figure 4C:
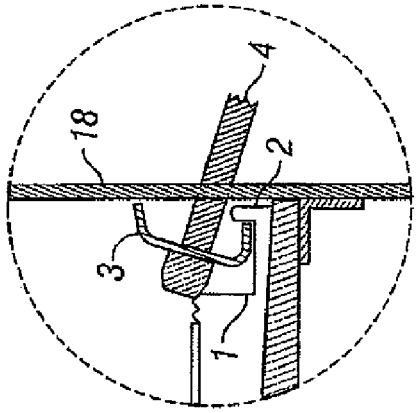
FIG. 4C shows a detailed view of the tensioning mechanism shown in FIGS. 4A and 4B.
Figure 4A:
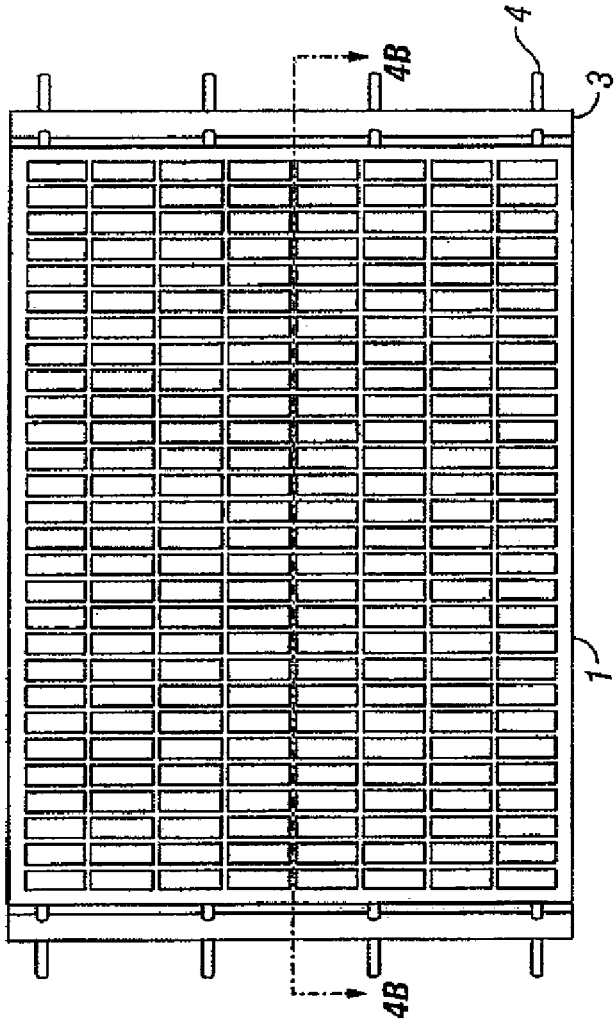
FIG. 4A shows a top view of a screen assembly mounted on a crowned deck in accordance with one embodiment of the present invention.
Figure 4B:
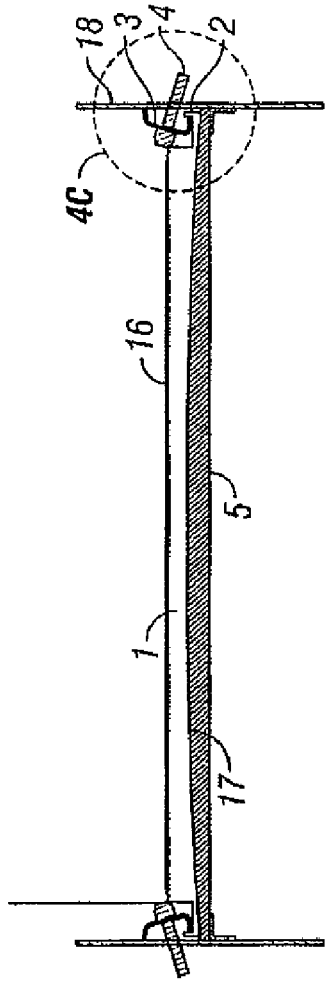
FIG. 4B shows an end view of the screen assembly shown in FIG. 4A.

Turning to FIGS. 4A and 4B, a screen assembly mounted to a crowned deck is shown in accordance with one embodiment of the present invention. FIG. 4C shows a detailed view of the tensioning mechanism on the shaker shown in FIGS. 4A and 4B. The underside 17 of the screen assembly is placed on the crowned deck 5. The underside 17 may be curved to be nearly equal to the curvature of the crowned deck 5. Preferably, the underside 17 has a radius of the curvature equal to or greater than the radius of the crowned deck 5. In this embodiment, the shaker has a draw bar 3 with tensioning bolts 4. The screen assembly is placed on the crowned deck such that the hook end 2 is underneath the draw bar 3. As the tension bolts 4 are tightened, the screen assembly is pulled towards the shaker side wall 18 and stretched by the draw bar 3 across the crowned deck 5. As the stretching occurs, the underside 17 of the screen assembly conforms to the shape of the crowned deck 5. The conforming that occurs will vary depending on how closely the radius of the underside 17 matches the radius of the crowned deck 5. If the radii are substantially equal, the top side 16 will be planar after tensioning the screen assembly. If the radius of the underside 17 is larger than the radius of the crowned deck 5, the top side 16 will be curved upward, but less curved than the crowned deck 5. If the radius of the underside 17 is smaller than the radius of the crowned deck 5, the top side 16 will be curved downward, which results in a U-shaped channel in the center. This situation should generally be avoided or minimized because the resulting center channel will reduce the effective screening area by primarily having fluid only in the center of the screen assembly. Thus, if the radius of the curvature of the underside 17 is smaller than the radius of the crowned deck 5, the top side 16 of the screen assembly may have a curvature to counter this U-shaped channel formation.

Figure 5C:
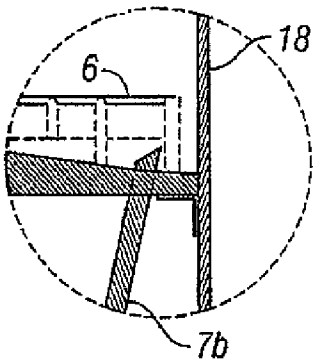
FIG. 5C shows a detailed view of the tensioning mechanism shown in FIGS. 5A and 5B.
Figure 5D:
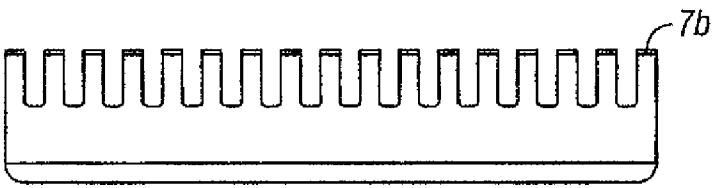
FIG. 5D shows a rake that can be used as a tensioning mechanism in accordance with one embodiment of the present invention.
Figure 5A:
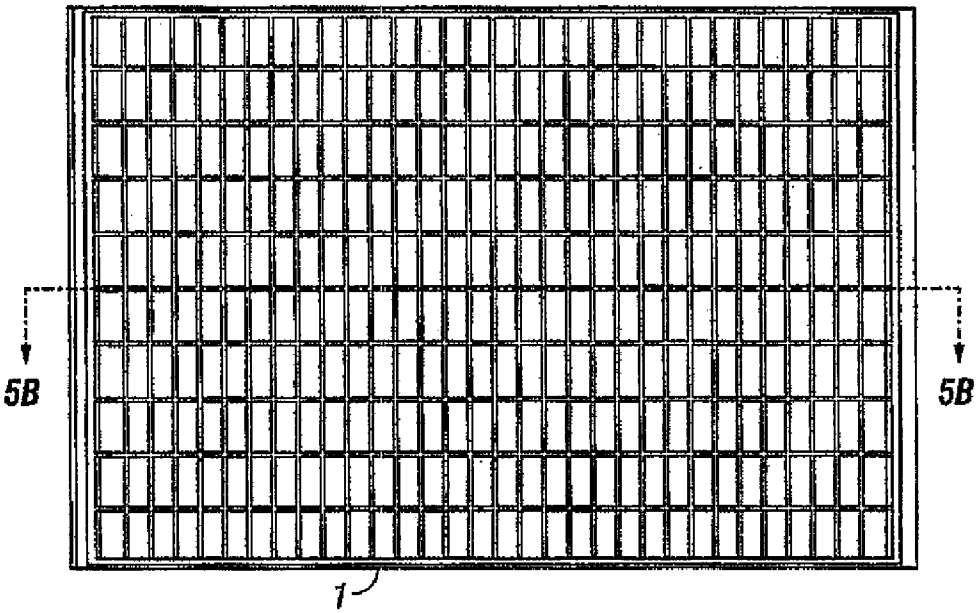
FIG. 5A shows a top view of a screen assembly mounted on a crowned deck in accordance with one embodiment of the present invention.
Figure 5B:
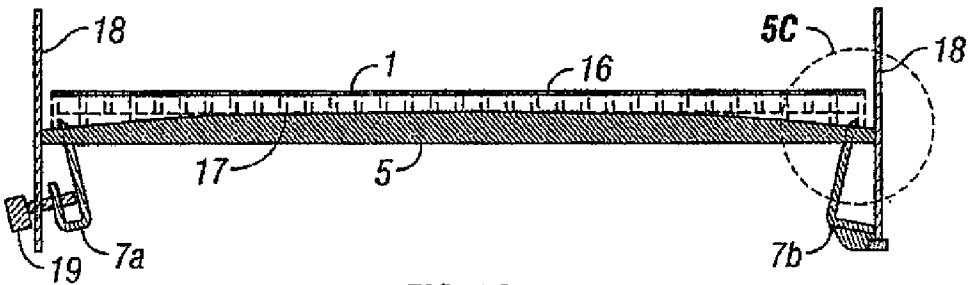
FIG. 5B shows an end view of the screen assembly shown in FIG. 5A.

FIGS. 5A and 5B show a screen assembly mounted to a crowned deck in accordance with one embodiment of the present invention. FIG. 5C shows a detailed view of the tensioning mechanism on the shaker shown in FIGS. 5A and 5B. In this embodiment, the shaker has a tensioning mechanism that uses two rakes 7A and 7B to tension the screen assembly. U.S. Pat. No. 6,669,027, entitled "Vibratory Screening Machine and Vibratory Screen and Screen Tensioning Structure," illustrates the function of the tensioning mechanism in greater detail. That patent is incorporated by reference in its entirety. FIG. 4D shows an example of rakes 7A and 7B that may be used as part of a tensioning mechanism. For compatibility with the mechanism, the screen frame 1 does not include a hook strip end. The rakes 7A and 7B fit in the openings of the screen frame 1. After placing the screen assembly on the crowned deck 5, a tension bolt 19 is tightened, which draws one rake 7A towards the shaker side wall 18. One of the rakes 7A pulls the sides of the screen frame 1 as it moves, while the other rake 7B remains fixed. This causes the underside 17 of the screen assembly to conform to the crowned deck 5. In an alternative embodiment, both rakes 7A and 7B may be moveable to tension the screen assembly. After proper tensioning, the screen assembly and shaker are ready for use. While two tensioning mechanisms have been shown, one of ordinary skill in the art will appreciate that the screen assembly may use other tensioning mechanisms known in the art without departing from the scope of the invention.

Figure 6C:
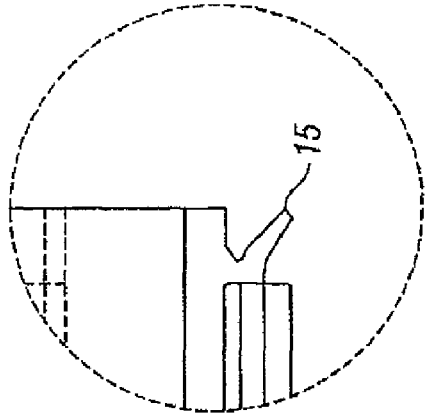
FIG. 6C shows a detailed view of the underside gasket shown in FIGS. 6A and 6B.
Figure 6B:
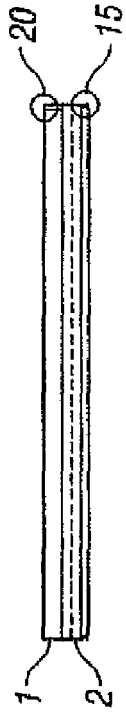
FIG. 6B shows an end view of the screen assembly shown in FIG. 6A.
Figure 6A:
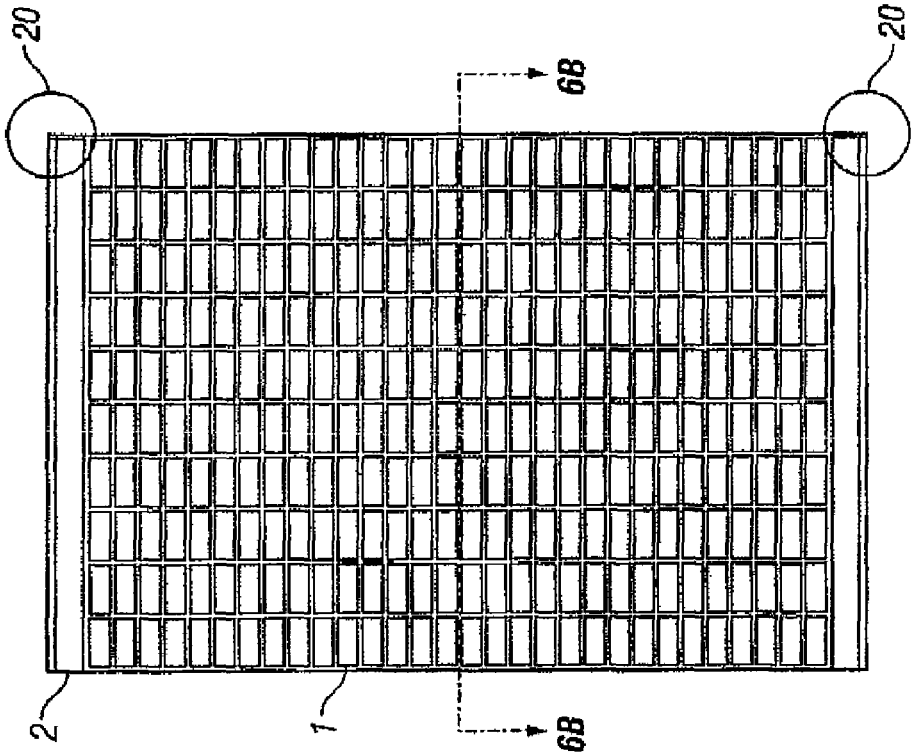
FIG. 6A shows a top view of a screen assembly having an underside gasket in accordance with one embodiment of the present invention.

In some embodiments, an additional sealing feature on the underside may be included. FIGS. 6A and 6B show a screen assembly having an underside gasket 15 in accordance with one embodiment of the present invention. FIG. 6C shows a detailed view of the underside gasket 15. An underside gasket 15 may be located on the ends of the screen assembly. When the screen assembly is tensioned, the underside gasket 15 forms a seal against the crowned deck. This is intended to help prevent fluid from bypassing the screen assembly without being screened. In one embodiment, the underside gasket 15 is integrally formed with the screen frame 1. In another embodiment, the underside gasket 15 is bonded or otherwise attached to the screen frame 1. The shape of the underside gasket 15 may vary depending on design considerations. While FIG. 6C shows a wiper shaped underside gasket 15, one of ordinary skill in the art will appreciate that the underside gasket 15 may be formed in other sealing shapes without departing from the scope of the invention.

In the embodiment shown in FIGS. 6A and 6B, an additional feature is shown on the screen assembly. A hook strip dam 20 is formed on the ends of each hook strip 2. When a screen assembly is fastened to a crowned deck with a hook strip 2, there is typically a small gap left on the sides of the screen assembly. This gap allows some fluid to bypass the screen mesh. The hook strip dams 20 reduce the amount of fluid that can bypasses the screen mesh. As fluid flows along the hook strip 2, the hook strip dams 20 force the fluid to flow back over the screen mesh. The hook strip dams 20 are preferably on the discharge end of the screening assembly. However, during installation, it is common for a screen assembly to be assembled in a reverse position by accident, which results in the hook strip dams 20 being on the intake end of the screening assembly. While this is somewhat less effective, the hook strip dams still help to reduce the amount of fluid that can bypass the screen mesh.

While the screen frames shown have a squared grid structure, other screen frames may be devised that conform to a crowned deck when pulled in tension. The cells in the grid structure may, for example, be circular or rectangular. Furthermore, the screen frame need not have uniform cells.

In the above embodiments, the screen frame has been designed to be flexible such that the underside conforms to the curvature of the crowned deck. Alternatively, a substantially rigid screen frame with a curved underside could be used. Such a rigid screen frame may have a soft material such as a rubber gasket attached to the curved underside. During attachment, the soft material would conform to the curvature of the crowned deck.

In the context of this disclosure, the term "crowned deck" is used to mean a non-planar deck of a shaker. The non-planar deck may have a number of forms. For example, the crowned deck may be shaped as an arc having a constant radius of the curvature across the entire length. Alternatively, a crowned deck may potentially be formed with a varying curvature, such as parabolic. Those having ordinary skill in the art will recognize that a number of linear and non-linear alternatives also exist in addition to the examples given above. One of ordinary skill in the art will appreciate that a crowned deck may have any non-planar surface for the attachment of a screen without departing from the scope of the invention.

Embodiments of the present invention offer one or more of the following advantages. The curved underside of the screen assembly along with a substantially planar top side essentially converts a crowned deck into a substantially flat deck. At the same time, the screen tension advantages of a crowned deck are maintained. When the screen assembly is stretched across the crowned deck, the underside of the screen assembly conforms to the curvature of the crowned deck. The more the underside of the screen assembly has to conform, the more curved the top side of the screen assembly will be. If the top side is not planar after tensioning, the result is still a screening surface that has a reduced curvature compared to the crowned deck. In addition, the top side may include some downward curvature towards the center to "counter" the anticipated curvature when the screen assembly is attached to a crowned deck.

The ability to conform the screen assembly to the crowned deck offers several advantages. By conforming, the underside contacts the crowned deck in a manner that leaves no significant gaps. This helps to prevent fluid loss. Additionally, tensioning of the screen assembly is more effective because the screen assembly fits tightly against the crowned deck. A more secured fitting of the screen assembly reduces undesirable flapping of the screens while operating the vibrating shaker. The ability to conform the screen assembly allows compensation for varying curvature for crowned decks. Different models of vibrating shakers have different curvatures of crowned decks, while sometimes sharing the same screen sizes. A screen assembly that is able to conform to the different curvatures may be used in the different models. Additionally, the curvature of the crowned decks varies within each model from manufacturing and from wear on the crowned decks. Conforming the screen to the crowned deck corrects for those differences.

As discussed in the Background, crowned decks result in a curved screen area that causes more fluid to collect on the sides of the screens than in the middle. In some cases, the middle of the screen will be without any fluid while the sides are filled. This reduces the effective screen area. Additionally, the sides of the screens may wear out while the middle exhibits little wear. Reducing the curvature of the screens increases the effective screening area by distributing the fluid more evenly over the surface of the screens. This evens out wear of the assembly, and more efficiently screens the fluids.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A screen assembly for attachment to a crowned deck of a vibrating shaker, wherein the crowned deck has a non-planar profile, the screen assembly comprising:

a screen frame formed from a primary material and a secondary material and having an underside and a top side, the screen assembly installed on the crowned deck and flexing such that the underside adapts to the non-planar profile of the crowned deck while the top side remains substantially flat; and at least one screen mesh attached to the top side of the screen assembly.

2. The screen assembly of claim 1, wherein the top side of the screen assembly is substantially flat.

3. The screen assembly of claim 1, wherein the underside of the screen assembly has a non-planar profile that is substantially identical to the non-planar profile of the crowned deck.

4. The screen assembly of claim 1, wherein a curvature of the underside of the screen assembly is greater than a curvature of the crowned deck.

5. The screen assembly of claim 1, wherein the secondary material is metal.

6. The screen assembly of claim 1, wherein the primary material is thermoplastic.

7. The screen assembly of claim 1 wherein the screen mesh is formed from metal.

8. The screen assembly of claim 1, wherein the screen mesh is fused to the screen frame using heat.

9. The screen assembly of claim 1, further comprising: a gasket configured to form a seal against the crowned deck.

10. A frame for a screen for attachment to a crowned deck of a vibrating shaker, wherein the crowned deck has a non-planar profile, the frame comprising:

a primary material and a secondary material and having an underside and a top side, wherein the underside has a non-planar profile;

the frame installed on the crowned deck and flexing such that the underside adapts to the non-planar profile of the crowned deck while the top side remains substantially flat.

11. The frame of claim 10, wherein the primary material is thermoplastic.

12. The frame of claim 10, wherein the secondary material is metal.

13. A frame for a screen for attachment to a crowned deck of a vibrating shaker, wherein the crowned deck has a curvature, the frame comprising:

a top side, wherein the top side is substantially flat;

an underside, wherein the underside has a curvature greater than the curvature of the crowned deck;

two sides configured to attach to the crowned deck;

a grid structure formed from a primary material;

a support grid formed from a secondary material of greater tensile strength than the primary material, wherein the support grid is embedded in the primary material, the frame installed on the crowned deck and flexing such that the underside adapts to the curvature of the crowned deck while the top side remains substantially flat.

14. The frame of claim 13, wherein the primary material is thermoplastic.

15. The frame of claim 13, wherein the secondary material is metal.

* * * * *